US010273985B2

(12) United States Patent
Kondo et al.

(10) Patent No.: US 10,273,985 B2
(45) Date of Patent: Apr. 30, 2019

(54) HYDRAULIC DRIVE SYSTEM OF CONSTRUCTION MACHINE

(71) Applicant: KAWASAKI JUKOGYO KABUSHIKI KAISHA, Kobe-shi, Hyogo (JP)

(72) Inventors: Akihiro Kondo, Nishinomiya (JP); Hideyasu Muraoka, Akashi (JP); Hiroaki Fujimoto, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 190 days.

(21) Appl. No.: 15/528,024

(22) PCT Filed: Feb. 22, 2016

(86) PCT No.: PCT/JP2016/000924
§ 371 (c)(1),
(2) Date: May 18, 2017

(87) PCT Pub. No.: WO2016/136229
PCT Pub. Date: Sep. 1, 2016

(65) Prior Publication Data

US 2018/0347598 A1 Dec. 6, 2018

(30) Foreign Application Priority Data

Feb. 23, 2015 (JP) ..... 2015-032599

(51) Int. Cl.
*F16D 31/02* (2006.01)
*F15B 11/17* (2006.01)
(Continued)

(52) U.S. Cl.
CPC ..... *F15B 11/17* (2013.01); *E02F 3/425* (2013.01); *E02F 9/123* (2013.01); *E02F 9/22* (2013.01);
(Continued)

(58) Field of Classification Search
CPC ..... F15B 11/161; F15B 11/165; F15B 11/17; F15B 2211/20553; E02F 9/2228; E02F 9/2285; E02F 9/2292; E02F 9/2296
(Continued)

(56) References Cited

U.S. PATENT DOCUMENTS 6,183,210 B1 * 2/2001 Nakamura ..... E02F 9/2235 417/222.1
9,181,684 B2 * 11/2015 Okano ..... E02F 9/2282
(Continued)

FOREIGN PATENT DOCUMENTS

CN 104314132 A 1/2015
JP H11-101183 A 4/1999
(Continued)

OTHER PUBLICATIONS

Nov. 6, 2017 Office Action issued in Chinese Patent Application No. 201680002014.4.
(Continued)

*Primary Examiner* — Michael Leslie
(74) *Attorney, Agent, or Firm* — Oliff PLC

(57) ABSTRACT

An object to reduce a relief amount at the start of turning. A hydraulic drive system of a construction machine includes: a turning control valve disposed on a first circulation line extending from a first pump; a boom control valve disposed on a second circulation line extending from a second pump; first and second regulators, which change tilting angles of the first and second pumps; and a controller, which controls one or more solenoid proportional valves, which output a secondary pressure to the first and second regulators. While a turning operation is being performed, if a discharge pressure of the first pump is higher than a first setting value and a discharge pressure of the second pump is lower than a second setting value, the controller lowers first and second
(Continued)

horsepower control lines that restrict discharge flow rates of the first and second pumps.

6 Claims, 12 Drawing Sheets

(51) Int. Cl.

| | |
|---|---|
| ***F15B 11/16*** | (2006.01) |
| ***E02F 9/22*** | (2006.01) |
| ***F15B 11/00*** | (2006.01) |
| ***E02F 3/42*** | (2006.01) |
| ***E02F 9/12*** | (2006.01) |

(52) U.S. Cl.
CPC ..... *E02F 9/2228* (2013.01); *E02F 9/2285* (2013.01); *E02F 9/2292* (2013.01); *E02F 9/2296* (2013.01); *F15B 11/00* (2013.01); *F15B 11/165* (2013.01); *F15B 2211/20546* (2013.01); *F15B 2211/20553* (2013.01); *F15B 2211/20576* (2013.01); *F15B 2211/255* (2013.01); *F15B 2211/2656* (2013.01); *F15B 2211/513* (2013.01); *F15B 2211/6309* (2013.01); *F15B 2211/6316* (2013.01); *F15B 2211/6652* (2013.01); *F15B 2211/6653* (2013.01); *F15B 2211/7053* (2013.01); *F15B 2211/7058* (2013.01); *F15B 2211/7135* (2013.01); *F15B 2211/78* (2013.01)

(58) Field of Classification Search
USPC ..... 60/428, 444, 447, 452
See application file for complete search history.

(56) References Cited

U.S. PATENT DOCUMENTS

| | | | | |
|---|---|---|---|---|
| 9,932,995 | B2 * | 4/2018 | Kondo | F15B 11/17 |
| 10,041,224 | B2 * | 8/2018 | Kondo | F15B 11/17 |
| 10,107,310 | B2 * | 10/2018 | Kondo | F15B 11/17 |
| 2016/0251833 | A1 * | 9/2016 | Kondo | F15B 11/17<br>60/428 |

FOREIGN PATENT DOCUMENTS

| | | | |
|---|---|---|---|
| JP | 2008-39063 | A | 2/2008 |
| JP | 2011-157790 | A | 8/2011 |
| JP | 2012-215193 | A | 11/2012 |
| JP | 2013-193840 | A | 9/2013 |

OTHER PUBLICATIONS

Nov. 6, 2017 Translation of SIPO Search Report issued in Chinese Patent Application No. 2016800020144.

* cited by examiner

HYDRAULIC DRIVE SYSTEM OF CONSTRUCTION MACHINE

TECHNICAL FIELD

The present invention relates to a hydraulic drive system of a construction machine.

BACKGROUND ART

Construction machines, such as hydraulic excavators and hydraulic cranes, perform various work by means of a hydraulic drive system. For example, Patent Literature 1 discloses a hydraulic drive system of a hydraulic excavator, which is configured such that hydraulic oil is supplied from a first pump and a second pump to a plurality of actuators via a plurality of control valves.

Specifically, in the hydraulic drive system disclosed in Patent Literature 1, a plurality of control valves including a boom control valve are disposed on a first circulation line extending from a first pump to a tank, and a plurality of control valves including a turning control valve are disposed on a second circulation line extending from a second pump to the tank. The first pump and the second pump are variable displacement pumps. The tilting angle of the first pump is changed by a first regulator, and the tilting angle of the second pump is changed by a second regulator.

Each of the first regulator and the second regulator includes a first servo valve for use in positive tilting control and a second servo valve for use in total horse power control. The first servo valve moves in accordance with a secondary pressure outputted from a first solenoid proportional valve, and the second servo valve moves in accordance with the discharge pressure of the first pump, the discharge pressure of the second pump, and a secondary pressure outputted from a second solenoid proportional valve.

Patent Literature 2 discloses a hydraulic drive system of a construction machine, which is configured to reduce a relief amount at the start of turning. Specifically, in the hydraulic drive system, a running control valve, a turning control valve, an arm control valve, a boom control valve, and a bucket control valve are disposed on a circulation line extending from a single variable displacement pump to a tank. The circulation line is provided with a pressure meter that measures the discharge pressure of the pump. The tilting angle of the pump is changed by a regulator, and a high pressure selective valve is connected to the regulator. The high pressure selective valve leads a higher one of the following pressures to the regulator: a negative control pressure, which is the pressure at the upstream side of a throttle provided on the circulation line; and a secondary pressure from a solenoid proportional valve. The solenoid proportional valve is controlled by a controller. The controller feeds a command current to the solenoid proportional valve for a predetermined time when a turning operation is performed and the amount of change in the discharge pressure of the pump has increased rapidly. As a result, a high secondary pressure is outputted from the solenoid proportional valve, and the discharge flow rate of the pump is suppressed temporarily. Consequently, the relief amount at the time of starting a turning motor is reduced.

CITATION LIST

Patent Literature

PTL 1: Japanese Laid-Open Patent Application Publication No. H11-101183

PTL 2: Japanese Laid-Open Patent Application Publication No. 2008-39063

SUMMARY OF INVENTION

Technical Problem

In the hydraulic drive system disclosed in Patent Literature 2, the control of suppressing the discharge flow rate of the pump is performed whenever a turning operation is performed. This technique can be applied to the hydraulic drive system disclosed in Patent Literature 1 by performing control in the following manner: whenever a turning operation is performed, control the solenoid proportional valves, each of which outputs a secondary pressure to the first or second regulator, such that the discharge flow rates of the first and second pumps are suppressed. However, with this control, when, for example, a turning operation and a boom raising operation are performed at the same time, even though the discharge flow rate of the second pump at the boom side is not intended to be suppressed, the discharge flow rate is suppressed unavoidably.

In view of the above, an object of the present invention is to provide a hydraulic drive system of a construction machine, the hydraulic drive system being configured to use a first pump and a second pump and being capable of: detecting, with a simple configuration, that a turning operation alone or operations similar to a turning operation alone are performed; and when it is detected that a turning operation alone or operations similar to a turning operation alone are performed, reducing the relief amount at the start of turning.

Solution to Problem

In order to solve the above-described problems, a hydraulic drive system of a construction machine according to the present invention includes: a variable displacement first pump; a turning control valve disposed on a first circulation line extending from the first pump to a tank, the turning control valve controlling supply and discharge of hydraulic oil to and from a turning motor; a variable displacement second pump; a boom control valve disposed on a second circulation line extending from the second pump to the tank, the boom control valve controlling supply and discharge of hydraulic oil to and from a boom cylinder; a first regulator that changes a tilting angle of the first pump; a second regulator that changes a tilting angle of the second pump; one or more solenoid proportional valves that output a secondary pressure to the first regulator and the second regulator; a first pump pressure meter that measures a discharge pressure of the first pump; a second pump pressure meter that measures a discharge pressure of the second pump; and a controller that controls the one or more solenoid proportional valves. While a turning operation is being performed, if the discharge pressure of the first pump, which is measured by the first pump pressure meter, is higher than a first setting value, and the discharge pressure of the second pump, which is measured by the second pump pressure meter, is lower than a second setting value, the controller feeds a command current to the one or more solenoid proportional valves, such that a first horsepower control line that restricts the discharge flow rate of the first pump and a second horsepower control line that restricts the discharge flow rate of the second pump are lowered.

According to the above configuration, it can be detected, with the simple configuration including the first pump pressure meter and the second pump pressure meter, that a turning operation alone or operations similar to a turning operation alone are performed. (Specific examples of the "operations similar to a turning operation alone" are given below in Description of Embodiments.) When it is detected that a turning operation alone or operations similar to a turning operation alone are performed, the first horsepower control line is lowered, and thereby the relief amount at the start of turning can be reduced. In addition, when it is detected that a turning operation alone or operations similar to a turning operation alone are performed, the second horsepower control line is also lowered. Therefore, in some cases, energy required for driving the second pump can be saved.

Each of the first regulator and the second regulator may include a multi-control piston that receives the secondary pressure outputted from the one or more solenoid proportional valves. A first main horsepower control line and a first auxiliary horsepower control line indicating less horsepower than the first main horsepower control line may each be stored as the first horsepower control line in the controller. A second main horsepower control line and a second auxiliary horsepower control line indicating less horsepower than the second main horsepower control line may each be stored as the second horsepower control line in the controller. While a turning operation is being performed, if the discharge pressure of the first pump is higher than the first setting value and the discharge pressure of the second pump is lower than the second setting value, the controller may feed a command current that is determined based the first auxiliary horsepower control line and a command current that is determined based on the second auxiliary horsepower control line to the one or more solenoid proportional valves. According to this configuration, the above-described advantages can be obtained in a case where the discharge flow rate of the first pump and the discharge flow rate of the second pump are controlled by electrical positive control.

The first regulator may include: a flow rate control piston that receives a first negative control pressure, which is a pressure at an upstream side of a throttle provided on the first circulation line; and a horsepower control piston that receives the discharge pressure of the first pump and the secondary pressure outputted from the one or more solenoid proportional valves and that determines the first horsepower control line. The second regulator may include: a flow rate control piston that receives a second negative control pressure, which is a pressure at an upstream side of a throttle provided on the second circulation line; and a horsepower control piston that receives the discharge pressure of the second pump and the secondary pressure outputted from the one or more solenoid proportional valves and that determines the second horsepower control line. While a turning operation is being performed, if the discharge pressure of the first pump is higher than the first setting value and the discharge pressure of the second pump is lower than the second setting value, the controller may feed a command current to the one or more solenoid proportional valves, such that the secondary pressure outputted from the one or more solenoid proportional valves increases. According to this configuration, the above-described advantages can be obtained in a case where the discharge flow rate of the first pump and the discharge flow rate of the second pump are controlled by hydraulic negative control.

For example, the above hydraulic drive system may further include a turning pressure meter that measures a turning pilot pressure outputted from a turning operation valve to the turning control valve. The controller may determine that a turning operation is being performed if the turning pilot pressure measured by the turning pressure meter is higher than a threshold.

Advantageous Effects of Invention

According to the present invention, it can be detected, with the simple configuration including the first pump and the second pump, that a turning operation alone or operations similar to a turning operation alone are performed. When it is detected that a turning operation alone or operations similar to a turning operation alone are performed, the relief amount at the start of turning can be reduced.

DESCRIPTION OF EMBODIMENTS

Embodiment 1

Figure 1:
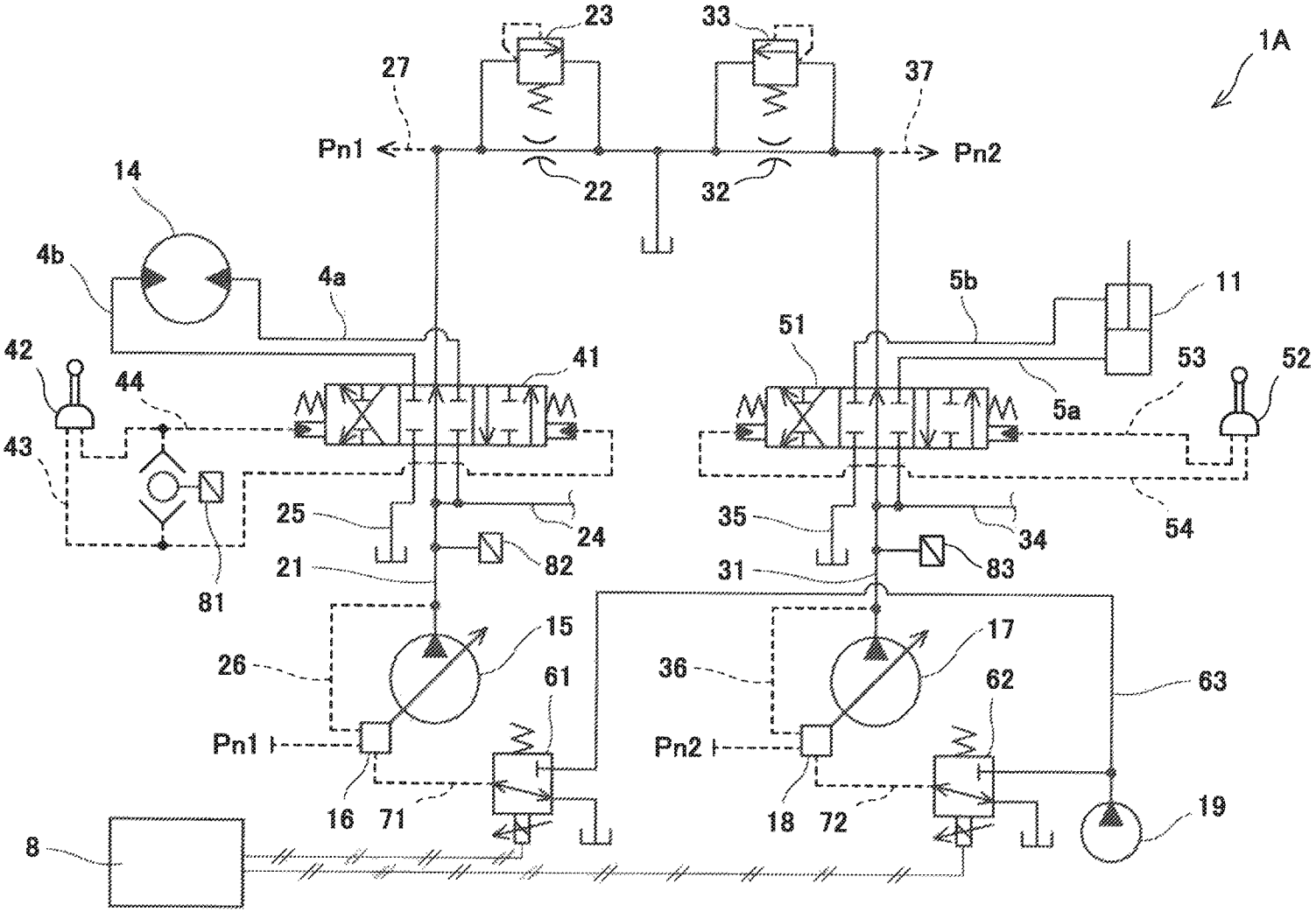
FIG. 1 shows a schematic configuration of a hydraulic drive system according to Embodiment 1 of the present invention.
Figure 2:
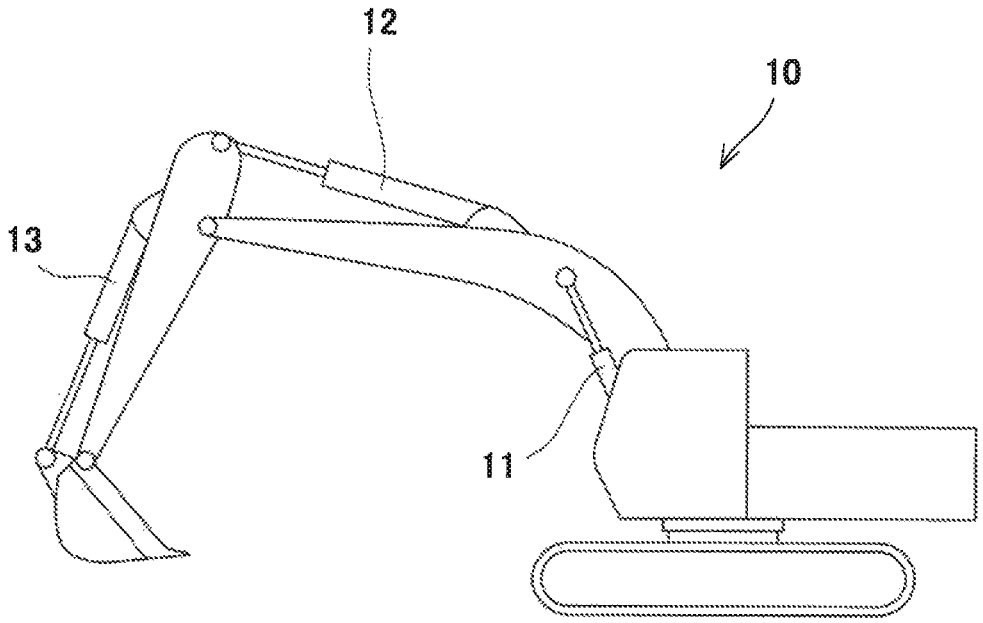
FIG. 2 is a side view of a hydraulic excavator, which is one example of a construction machine.

FIG. 1 shows a hydraulic drive system 2A of a construction machine according to Embodiment 1 of the present invention. FIG. 2 shows a construction machine 10, in which the hydraulic drive system 1A is installed. Although the construction machine 10 shown in FIG. 2 is a hydraulic excavator, the present invention is applicable to other construction machines, such as a hydraulic crane.

The hydraulic drive system 1A includes, as hydraulic actuators, a boom cylinder 11, an arm cylinder 12, and a bucket cylinder 13, which are shown in FIG. 2, and also a turning motor 14 shown in FIG. 1 and a pair of right and left running motors, which are not shown. The hydraulic drive system 1A further includes: a first pump 15 and a second pump 17, which supply hydraulic oil to these actuators; and an engine (not shown) driving the first pump 15 and the second pump 17. It should be noted that, in FIG. 1, the actuators other than the boom cylinder 11 and the turning motor 14 are not shown for the purpose of simplifying the drawing.

In the present embodiment, the construction machine 10 is a self-propelled hydraulic excavator. In a case where the construction machine 10 is a hydraulic excavator mounted on a ship, a turning unit including an operator cab is turnably supported by the hull of the ship.

A first circulation line 21 extends from the first pump 15 to a tank. A plurality of control valves including a turning control valve 41 (the control valves other than the turning control valve 41 are not shown) are disposed on the first circulation line 21. The control valves other than the turning control valve 41 are, for example, an arm control valve and a left running control valve. The turning control valve 41 controls the supply and discharge of hydraulic oil to and from the turning motor 14, and the other control valves also control the supply and discharge of hydraulic oil to and from respective actuators. A parallel line 24 branches off from the first circulation line 21. The hydraulic oil discharged from the first pump 15 is led to all the control valves on the first circulation line 21 through the parallel line 24.

Similarly, a second circulation line 31 extends from the second pump 17 to the tank. A plurality of control valves including a boom control valve 51 (the control valves other than the boom control valve 51 are not shown) are disposed on the second circulation line 31. The control valves other than the boom control valve 51 are, for example, a bucket control valve and a right running control valve. The boom control valve 51 controls the supply and discharge of hydraulic oil to and from the boom cylinder 11, and the other control valves also control the supply and discharge of hydraulic oil to and from respective actuators. A parallel line 34 branches off from the second circulation line 31. The hydraulic oil discharged from the second pump 17 is led to all the control valves on the second circulation line 31 through the parallel line 34.

The turning control valve 41 is connected to the turning motor 14 by a left turning supply line 4*a* and a right turning supply line 4*b*. Relief passages (not shown) are connected to the left turning supply line 4*a* and the right turning supply line 4*b*. These relief passages are provided with relief valves (not shown). A tank line 25 is connected to the turning control valve 41. The turning control valve 41 includes a pair of pilot ports. These pilot ports are connected to a turning operation valve 42 by a left turning pilot line 43 and a right turning pilot line 44, respectively. The turning operation valve 42 includes an operating lever. The turning operation valve 42 outputs, to the turning control valve 41, a turning pilot pressure (a left turning pilot pressure or a right turning pilot pressure) whose magnitude corresponds to an inclination angle (an operation amount) of the operating lever.

The boom control valve 51 is connected to the boom cylinder 11 by a boom raising supply line 5*a* and a boom lowering supply line 5*b*. A tank line 35 is connected to the boom control valve 51. The boom control valve 51 includes a pair of pilot ports. These pilot ports are connected to a boom operating valve 52 by a boom raising pilot line 53 and a boom lowering pilot line 54, respectively. The boom operating valve 52 includes an operating lever. The boom operating valve 52 outputs, to the boom control valve 51, a boom pilot pressure (a boom raising pilot pressure or a boom lowering pilot pressure) whose magnitude corresponds to an inclination angle (an operation amount) of the operating lever.

Each of the first pump 15 and the second pump 17 is a variable displacement pump (a swash plate pump or a bent axis pump) whose tilting angle can be changed. The tilting angle of the first pump 15 is changed by a first regulator 16, and the tilting angle of the second pump 17 is changed by a second regulator 18. In the present embodiment, the discharge flow rates of the first pump 15 and the second pump 17 are controlled by hydraulic negative control.

Specifically, the first circulation line 21 is provided with a throttle 22, which is positioned downstream of all the control valves on the first circulation line 21. A bypass line that bypasses the throttle 22 is connected to the first circulation line 21. A relief valve 23 is disposed on the bypass line. Similarly, the second circulation line 31 is provided with a throttle 32, which is positioned downstream of all the control valves on the second circulation line 31. A bypass line that bypasses the throttle 32 is connected to the second circulation line 31. A relief valve 33 is disposed on the bypass line.

A first negative control pressure, which is the pressure at the upstream side of the throttle 22 on the first circulation line 21, is led to the first regulator 16 through a first flow rate control line 27. The discharge pressure of the first pump 15 is led to the first regulator 16 through a first horsepower control line 26. The present embodiment does not adopt cross sensing, and the discharge pressure of the second pump 17 is not led to the first regulator 16. Further, a secondary pressure from a first solenoid proportional valve 61 is outputted as a first power shift pressure Pf1 to the first regulator 16 through a first power shift line 71.

Similarly, a second negative control pressure, which is the pressure at the upstream side of the throttle 32 on the second circulation line 31, is led to the second regulator 18 through a second flow rate control line 37. The discharge pressure of the second pinup 17 is led to the second regulator 18 through a second horsepower control line 36. The present embodiment does not adopt cross sensing, and the discharge pressure of the first pump 15 is not led to the second regulator 18. Further, a secondary pressure from a second solenoid proportional valve 62 is outputted as a second power shift pressure Pf2 to the second regulator 18 through a second power shift line 72.

As flow rate control, the first regulator 16 decreases the tilting angle of the first pump 15 when the first negative control pressure is high, and increases the tilting angle of the first pump 15 when the first negative control pressure is low. As horsepower control, the first regulator 16 decreases the tilting angle of the first pump 15 when the discharge pressure of the first pump 15 and the first power shift pressure Pf1 are high, and increases the tilting angle of the first pump 15 when the discharge pressure of the first pump 15 and the first power shift pressure Pf1 are low. When the tilting angle of the first pump 15 decreases, the discharge flow rate of the first pump 15 decreases, and when the tilting angle of the first pump 15 increases, the discharge flow rate of the first pump 15 increases.

Similarly, as flow rate control, the second regulator 18 decreases the tilting angle of the second pump 17 when the second negative control pressure is high, and increases the tilting angle of the second pump 17 when the second negative control pressure is low. As horsepower control, the second regulator 18 decreases the tilting angle of the second pump 17 when the discharge pressure of the second pump 17 and the second power shift pressure Pf2 are high, and increases the tilting angle of the second pump 17 when the discharge pressure of the second pump 17 and the second power shift pressure Pf2 are low. When the tilting angle of the second pump 17 decreases, the discharge flow rate of the second pump 17 decreases, and when the tilting angle of the second pump 17 increases, the discharge flow rate of the second pump 17 increases.

Figure 3:
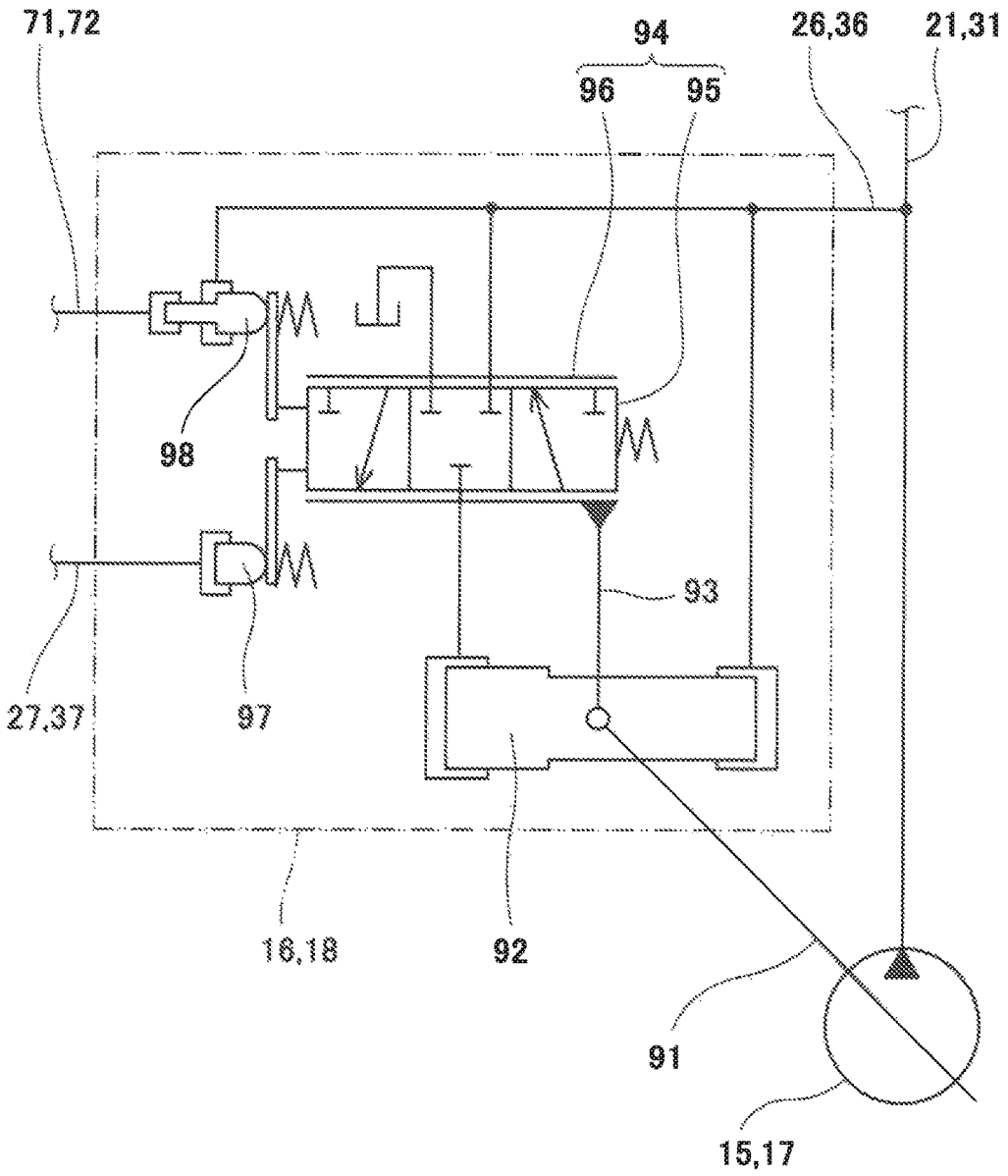
FIG. 3 shows a schematic configuration of a first regulator and a second regulator used in Embodiment 1.

The first regulator 16 and the second regulator 18 have the same configuration as shown in FIG. 3. Therefore, the configuration of the first regulator 16 is described below as a representative example.

The first regulator 16 includes: a servo cylinder 92, which adjusts the tilting angle of the first pump 15; and a switching valve 94, which operates the servo cylinder 92. For example, in a case where the first pump 15 is a swash plate pump, the servo cylinder 92 is coupled to a swash plate 91 of the first pump 15. The discharge pressure of the first pump 15 is applied to the smaller-diameter side of the servo cylinder 92, and a control pressure outputted from the switching valve 94 is applied to the larger-diameter side of the servo cylinder 92. The switching valve 94 includes: a sleeve 96 coupled to the servo cylinder 92 by a lever 93; and a spool 95 accommodated in the sleeve 96. The position of the sleeve 96 relative to the spool 95 is adjusted such that force (pressure×pressure receiving area of the servo cylinder) applied to both sides of the servo cylinder 92 is in balance.

The spool 95 of the switching valve 94 is driven by a flow rate control piston 97 and a horsepower control piston 98. The flow rate control piston 97 receives the first negative control pressure. When the first negative control pressure increases, the flow rate control piston 97 moves the spool 95 in a flow-rate-decreasing direction (i.e., in such a direction as to decrease the discharge flow rate of the first pump 15). When the first negative control pressure decreases, the flow rate control piston 97 moves the spool 95 in a flow-rate-increasing direction (i.e., in such a direction as to increase the discharge flow rate of the first pump 15). The horsepower control piston 98 receives the discharge pressure of the first pump 15 and the first power shift pressure Pf1. When the discharge pressure of the first pump 15 and the first power shift pressure Pf1 increase, the horsepower control piston 98 moves the spool 95 in the flow-rate-decreasing direction. When the discharge pressure of the first pump 15 and the first power shift pressure Pf1 have decreased, the horsepower control piston 98 moves the spool 95 in the flow-rate-increasing direction. It should be noted that the flow rate control piston 97 and the horsepower control piston 98 are configured such that one of these pistons is caused to function in priority to the other piston, the one piston restricting (decreasing) the discharge flow rate of the first pump 15 to a greater degree than the other piston.

Returning to FIG. 1, the first solenoid proportional valve 61 and the second solenoid proportional valve 62 are connected to an auxiliary pump 19 by a primary pressure line 63. The auxiliary pump 19 is driven by the engine (not shown), which drives the first and second pumps 15 and 17. The first solenoid proportional valve 61 and the second solenoid proportional valve 62 are controlled by a controller 8. That is, the controller 8 feeds a command current to the first solenoid proportional valve 61 and the second solenoid proportional valve 62. The controller 8 is a computer including a CPU, memories such as a ROM and RAM, I/F (Interface), I/O (Input/output Port), etc.

Figure 5A:
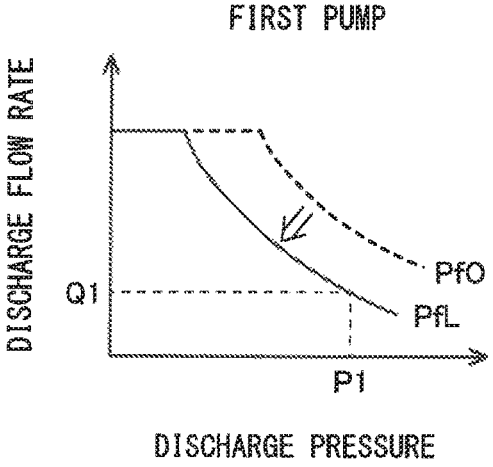
FIGS. 5A and 5B are graphs showing a first horsepower control line that restricts the discharge flow rate of a first pump and a second horsepower control line that restricts the discharge flow rate of a second pump in Embodiment 1.

The horsepower control piston 98 of the first regulator 16 determines a first horsepower control line that restricts the discharge flow rate of the first pump 15 in accordance with the discharge pressure of the first pump 15 as shown in FIG. 5A. As described above, since the horsepower control piston 98 receives the first power shift pressure Pf1 outputted from the first solenoid proportional valve 61, the first horsepower control line is lowered in accordance with increase in the first power shift pressure Pf1, and the first horsepower control line is raised in accordance with decrease in the first power shift pressure Pf1. Therefore, the first power shift pressure Pf1 at a normal time is set to a relatively high reference pressure Pf0 so that the first horsepower control line can be raised. It should be noted that in a case where itis not necessary to raise the first horsepower control line, the reference pressure Pf0 may be zero.

Figure 5B:
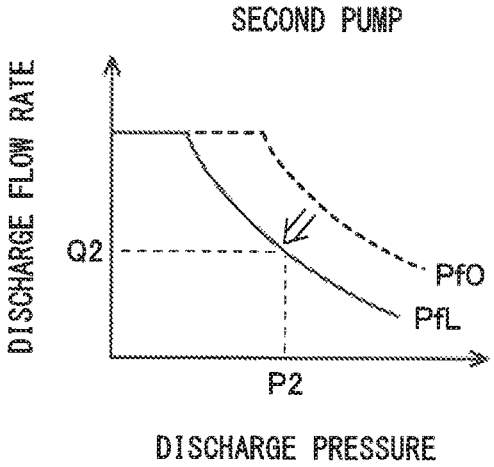

Similarly, the horsepower control piston 98 of the second regulator 18 determines a second horsepower control line that restricts the discharge flow rate of the second pump 17 in accordance with the discharge pressure of the second pump 17 as shown in FIG. 5B. Similar to the above-described horsepower control piston 98 of the first regulator 16, the horsepower control piston 98 of the second regulator 18 receives the second power shift pressure Pf2 outputted from the second solenoid proportional valve 62. Accordingly, the second horsepower control line is lowered in accordance with increase in the second power shift pressure Pf2, and the second horsepower control line is raised in accordance with decrease in the second power shift pressure Pf2. Therefore, the second power shift pressure Pf2 at a normal time is set to a relatively high reference pressure Pf0 so that the second horsepower control line can be raised. The reference pressure Pf0 of the second horsepower control line may be the same as or different from the reference pressure Pf0 of the first horsepower control line. It should be noted that in a case where it is not necessary to raise the second horsepower control line, the reference pressure Pf0 may be zero.

In the present embodiment, each of the first solenoid proportional valve 61 and the second solenoid proportional valve 62 is a direct proportional valve, that is, a command current and a power shift pressure (the first power shift pressure Pf1 or the second power shift pressure Pf2) indicate a positive correlation. However, as an alternative, each of the first solenoid proportional valve 61 and the second solenoid proportional valve 62 may be an inverse proportional valve, that is, the command current and the power shift pressure indicate a negative correlation.

The controller 8, which feeds a command current to the first solenoid proportional valve 61 and the second solenoid proportional valve 62, is connected to a turning pressure meter 81, a first pump pressure meter 82, and a second pump pressure meter 83. The turning pressure meter 81 measures a turning pilot pressure (a left turning pilot pressure or a right turning pilot pressure) outputted from the turning operation valve 42. In the present embodiment, the turning pressure meter 81 is configured to selectively measure a higher one of the pilot pressures of the left turning pilot line 43 and the right turning pilot line 44. However, as an alternative, the turning pressure meter 81 may be provided on each of the left turning pilot line 43 and the right turning pilot line 44.

The first pump pressure meter 82 is provided on the first circulation line 21, and measures the discharge pressure of the first pump 15. The second pump pressure meter 83 is provided on the second circulation line 31, and measures the discharge pressure of the second pump 17.

Figure 4:
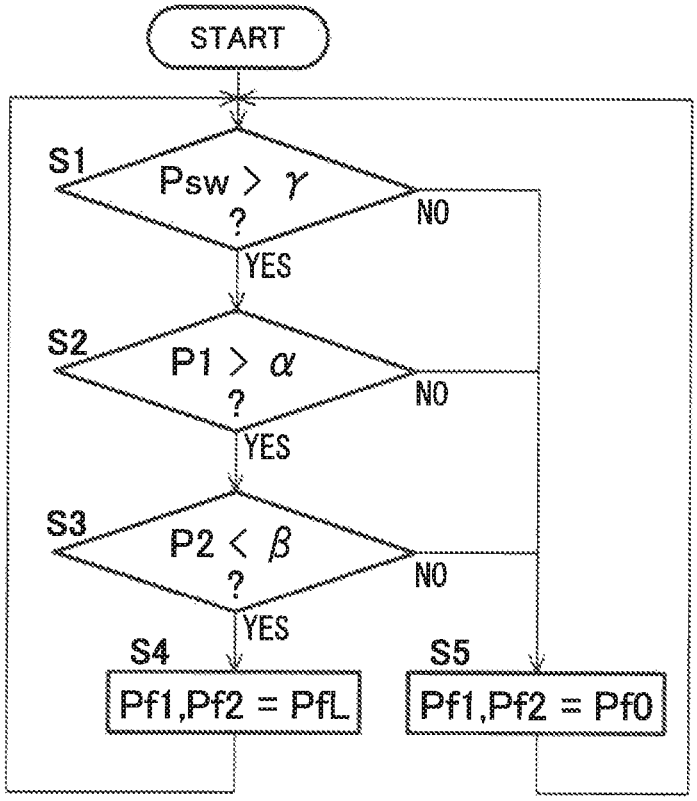
FIG. 4 is a flowchart of control performed by a controller in Embodiment 1.

While a turning operation is being performed, if the discharge pressure of the first pump 15 is higher than a first setting value α and the discharge pressure of the second pump 17 is lower than a second setting value β, the controller 8 lowers the first horsepower control line that restricts the discharge flow rate of the first pump 15 and the second horsepower control line that restricts the discharge flow rate of the second pump 17. Specifically, the controller 8 performs control in accordance with a flowchart shown in FIG. 4.

First, the controller 8 compares a turning pilot pressure Psw measured by the turning pressure meter 81 with a threshold γ (step S1). The threshold γ is 0.1 to 0.6 MPa, for example. If the turning pilot pressure Psw is not higher than the threshold γ (NO in step S1), the controller 8 determines that no turning operation is being performed, and proceeds to step S5. In step S5, the controller 8 feeds, to the first solenoid proportional valve 61, such a command current that the first power shift pressure Pf1 is adjusted to the reference pressure Pf0, and feeds, to the second solenoid proportional valve 62, such a command current that the second power shift pressure Pf2 is adjusted to the reference pressure Pf0. As a result, the first horsepower control line is set to be high as indicated by a dashed line in FIG. 5A, and also, the second horsepower control line is set to be high as indicated by a dashed line in FIG. 5B.

On the other hand, if the turning pilot pressure Psw is higher than the threshold γ (YES in step S1), the controller 8 determines that a turning operation is being performed, and proceeds to step S2. In step S2, the controller 8 compares a discharge pressure P1 of the first pump 15, which is measured by the first pump pressure meter 82, with the first setting value α. The first setting value α herein is an index for determining whether or not the control valves on the first circulation line 21 other than the turning control valve 41 are being operated. The reason for this is that while only the turning control valve 41 is being operated, the discharge pressure of the first circulation line 21 increases to the relief pressure of the above-described relief valve. For example, the first setting value α is 10 to 25 MPa.

If the discharge pressure P1 of the first pump 15 is not higher than the first setting value α (NO in step S2), since this means that the hydraulic oil discharged from the first pump 15 is also supplied to the actuators other than the turning motor 14, the controller 8 proceeds to step S5 in order to avoid reduction in the relief amount of the turning motor 14. On the other hand, if the discharge pressure P1 of the first pump 15 is higher than the first setting value α (YES in step S2), the controller 8 proceeds to step S3 in order to reduce the relief amount of the turning motor 14.

In step S3, the controller 8 compares a discharge pressure P2 of the second pump 17, which is measured by the second pump pressure meter 83, with the second setting value β. The second setting value β herein is an index for determining whether or not the load on the second pump 17 is small. That is, if the discharge pressure P1 of the first pump 15 is higher than the first setting value α and the discharge pressure P2 of the second pump 17 is small, it can be determined that a turning operation alone or operations similar to a turning operation alone are performed. For example, the second setting value β is 8 to 27 MPa.

The control valves on the second circulation line 31 include a bucket control valve (not shown) that controls the supply and discharge of hydraulic oil to and from the bucket cylinder 13. The load on the second pump 17 being small means one of the following: all the control valves on the second circulation line 31 are not operating; a boom lowering operation is being performed; and a bucket operation is being performed.

If the discharge pressure P2 of the second pump 17 is not lower than the second setting value β (NO in step S3), the controller 8 proceeds to step S5 in order to avoid reduction in the relief amount of the turning motor 14. On the other hand, if the discharge pressure P2 of the second pump 17 is lower than the second setting value β (YES in step S3), the controller 8 proceeds to step S4 in order to reduce the relief amount of the turning motor 14.

In step S4, the controller 8 feeds, to the first solenoid proportional valve 61, such a command current that the first power shift pressure Pf1 is adjusted to a suppressing pressure PfL higher than the reference pressure Pf0, and feeds, to the second solenoid proportional valve 62, such a command current that the second power shift pressure Pf2 is adjusted to a suppressing pressure PfL higher than the reference pressure Pf0. Specifically, the controller 8 increases the command currents that are being fed to the first solenoid proportional valve 61 and the second solenoid proportional valve 62. As a result, the first power shift pressure Pf1 outputted from the first solenoid proportional valve 61 increases, and the first horsepower control line is lowered as indicated by a solid line in FIG. 5A. Also, the second power shift pressure Pf2 outputted from the second solenoid proportional valve 62 increases, and the second horsepower control line is lowered as indicated by a solid line in FIG. 5B. It should be noted that the suppressing pressure PfL of the second horsepower control line may be the same as or different from the suppressing pressure PfL of the first horsepower control line.

As described above, the hydraulic drive system 1A according to the present embodiment is capable of detecting, with the simple configuration using the first pump pressure meter 82 and the second pump pressure meter 83, that a turning operation alone or operations similar to a turning operation alone are performed. When it is detected that a turning operation alone or operations similar to a turning operation alone are performed, the first horsepower control line is lowered, and thereby the relief amount at the start of turning can be reduced. In addition, when it is detected that a turning operation alone or operations similar to a turning operation alone are performed, the second horsepower control line is also lowered. This makes it possible to save energy that is required for driving the second pump 17 when operations similar to a turning operation alone are performed (e.g., when turning and boom lowering operations are performed at the same time or turning and bucket operations are performed at the same time).

In order to apply the configuration of the present embodiment to a hydraulic drive system of an existing construction machine, in most cases, installing the turning pressure meter 81 will suffice (in most cases, the first pump pressure meter 82 and the second pump pressure meter 83 are standard equipment). Since it is not necessary to modify the hydraulic circuit, the existing hydraulic drive system can be readily improved.

Embodiment 2

Next, a hydraulic drive system 1B of a construction machine according to Embodiment 2 of the present invention is described with reference to FIG. 6. In the present embodiment and Embodiments 3 and 4 described below, the same components as those described in Embodiment 1 are denoted by the same reference signs as those used in Embodiment 1, and repeating the same descriptions is avoided.

In the present embodiment, the first regulator 16 and the second regulator 18 are connected to one solenoid proportional valve 64 by a power shift line 73. Specifically, the solenoid proportional valve 64 outputs a secondary pressure as a power shift pressure to the first regulator 16 and the second regulator 18. The solenoid proportional valve 64 is connected to the auxiliary pump 19 by the primary pressure line 63.

The controller 8 feeds a command current to the solenoid proportional valve 64 in the same manner as in Embodiment 1. Specifically, the controller 8 feeds a command current to the solenoid proportional valve 64, such that the power shift pressure outputted from the solenoid proportional valve 64 to the first regulator 16 and the second regulator 18 is adjusted to the reference pressure Pf0 in step S5 of FIG. 4, and such that the power shift pressure is adjusted to the suppressing pressure PfL in step S4 of FIG. 4. Accordingly, when it is determined YES in step S3, the power shift pressure outputted from the solenoid proportional valve 64 increases, and the first horsepower control line and the second horsepower control line are lowered.

The present embodiment provides the same advantages as those provided by Embodiment 1.

Embodiment 3

Figure 7:
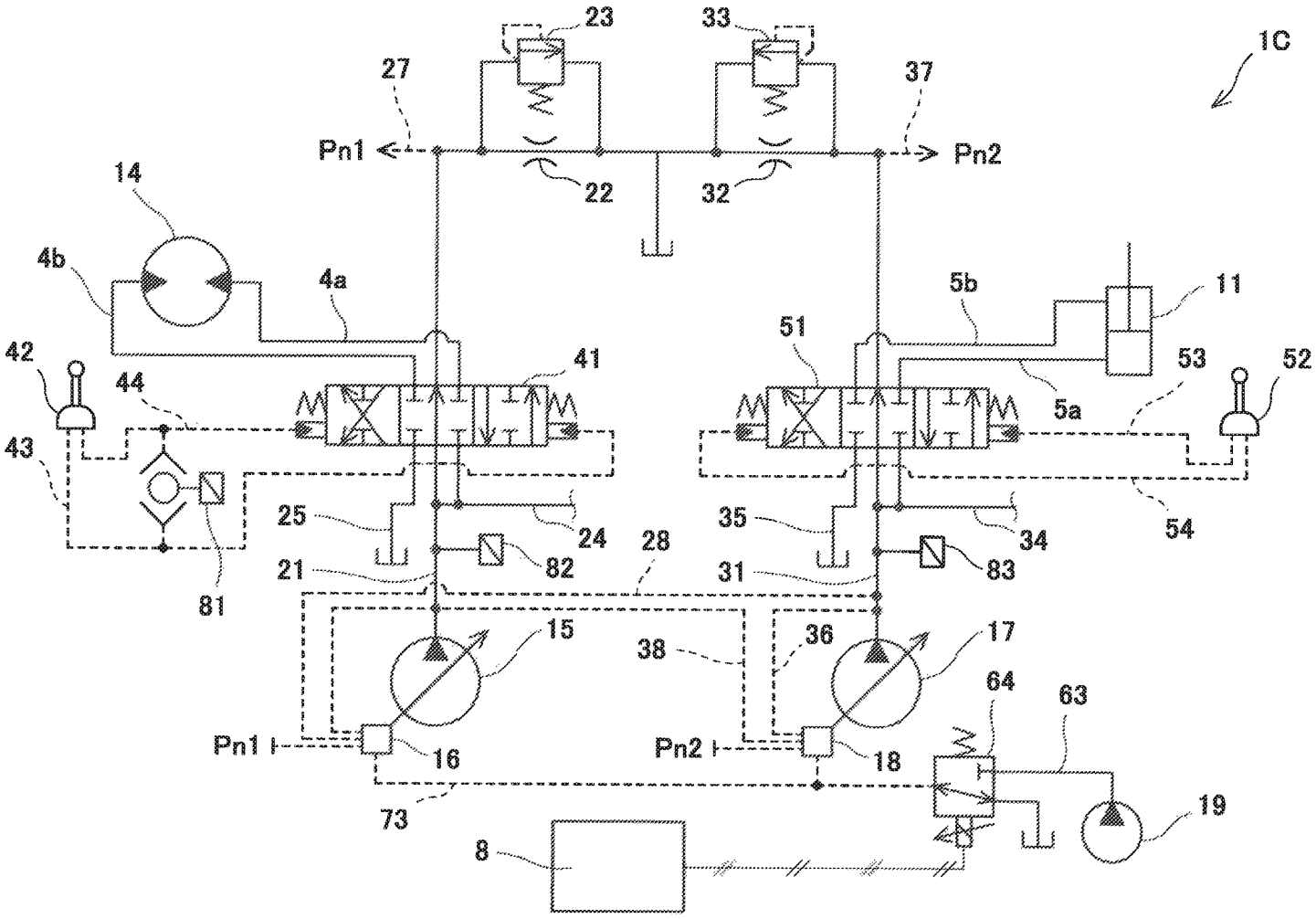
FIG. 7 shows a schematic configuration of a hydraulic drive system according to Embodiment 3 of the present invention.

Next, a hydraulic drive system 1C of a construction machine according to Embodiment 3 of the present invention is described with reference to FIG. 7 and FIGS. 8A and 8B.

The only difference between the hydraulic drive system 1C of Embodiment 3 and the hydraulic drive system 1B of Embodiment 2 is that the hydraulic drive system 1C of Embodiment 3 adopts cross sensing. Specifically, the discharge pressure of the second pump 17 is led to the first regulator 16 through a cross sensing line 28, and the discharge pressure of the first pump 15 is led to the second regulator 18 through a cross sensing line 38. More specifically, the horsepower control piston 98 (see FIG. 3) of the first regulator 16 receives the discharge pressure of the second pump 17, and the horsepower control piston 98 (see FIG. 3) of the second regulator 18 receives the discharge pressure of the first pump 15.

Figure 8A:
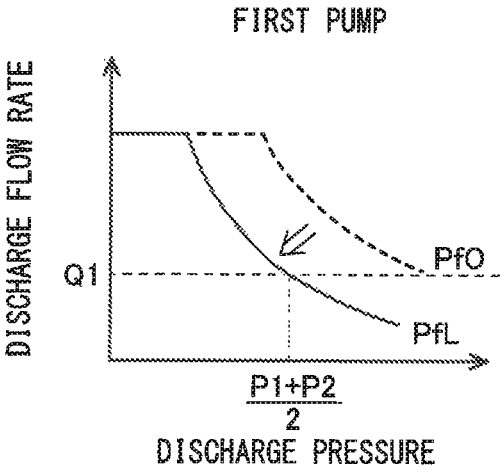
FIGS. 8A and 8B are graphs showing the first horsepower control line that restricts the discharge flow rate of the first pump and the second horsepower control line that restricts the discharge flow rate of the second pump in Embodiment 3.
Figure 8B:
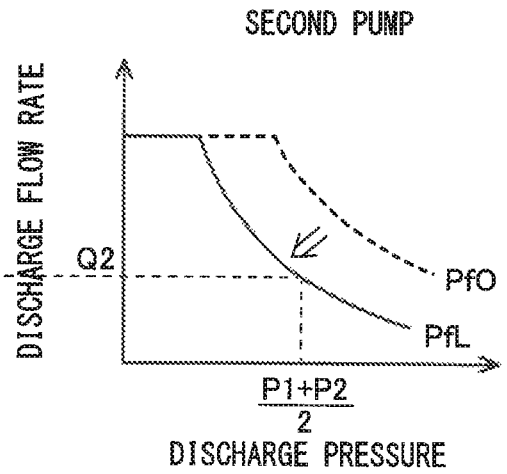
Figure 9:
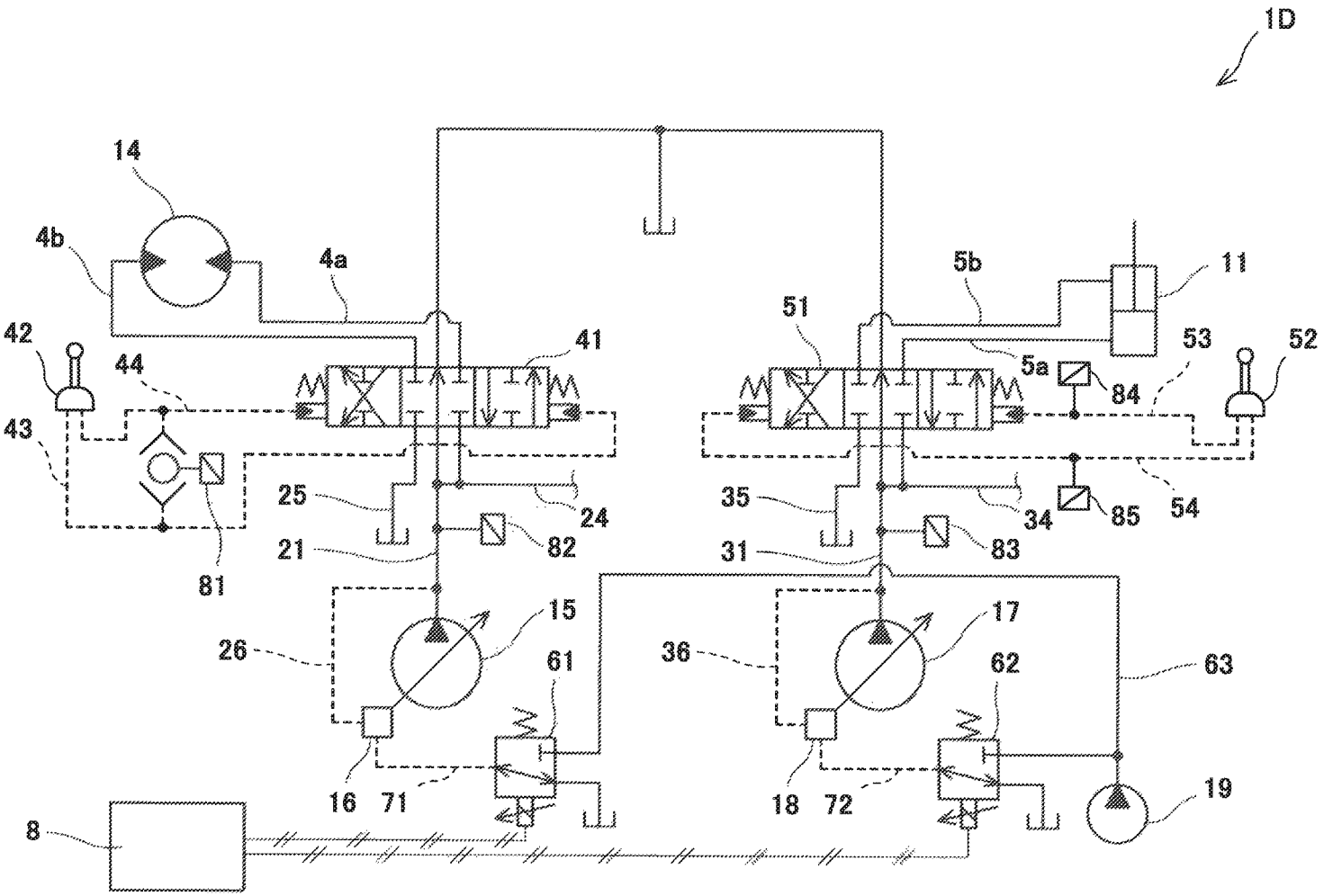
FIG. 9 shows a schematic configuration of a hydraulic drive system according to Embodiment 4 of the present invention.

Accordingly, as shown in FIGS. 8A and 8B, the discharge flow rate of the first pump 15 is always equal to the discharge flow rate of the second pump 17. Except this point, Embodiment 3 provides the same advantages as those provided by Embodiment 2. It should be noted that if cross sensing is not adopted as in Embodiment 1 and Embodiment 2, then the discharge flow rate of the first pump 15 and the discharge flow rate of the second pump 17 can be controlled separately.

Embodiment 4

Next, a hydraulic drive system 1D of a construction machine according to Embodiment 4 of the present invention is described with reference to FIG. 9, FIG. 10, FIG. 11, and FIGS. 12A and 12B. In the present embodiment, the discharge flow rates of the first pump 15 and the second pump 17 are controlled by electrical positive control.

Since the present embodiment adopts electrical positive control, the boom raising pilot line 53 and the boom lowering pilot line 54 are provided with a boom pressure meter 84 and a boom pressure meter 85, respectively, each of which measures a boom pilot pressure outputted from the boom operating valve 52.

Figure 10:
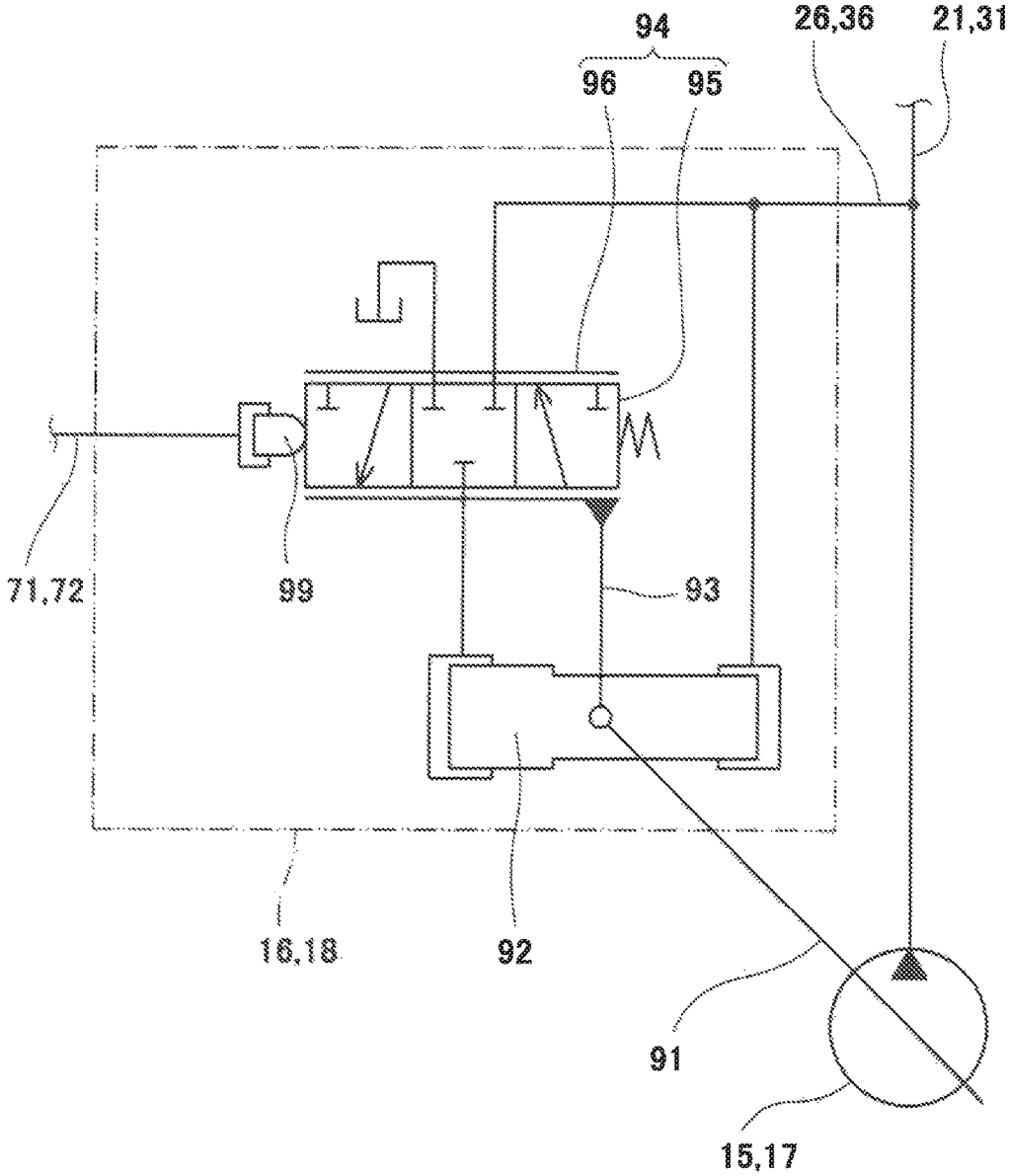
FIG. 10 shows a schematic configuration of the first regulator and the second regulator used in Embodiment 4.

The first regulator 16 and the second regulator 18 have the same configuration as shown in FIG. 10. In the present embodiment, the first regulator 16 includes a multi-control piston 99 instead of the flow rate control piston 97 and the horsepower control piston 98 shown in FIG. 3, the multi-control piston 99 receiving a secondary pressure outputted from the first solenoid proportional valve 61. The second regulator 18 also includes a multi-control piston 99 instead of the flow rate control piston 97 and the horsepower control piston 98 shown in FIG. 3, the multi-control piston 99 receiving a secondary pressure outputted from the second solenoid proportional valve 62.

Figure 12A:
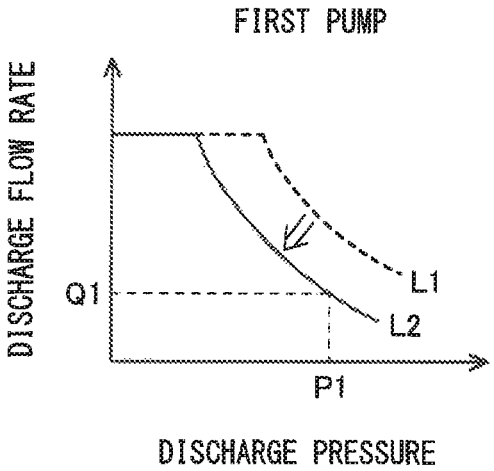
FIGS. 12A and 12B are graphs showing the first horsepower control line that restricts the discharge flow rate of the first pump and the second horsepower control line that restricts the discharge flow rate of the second pump in Embodiment 4.
Figure 12B:
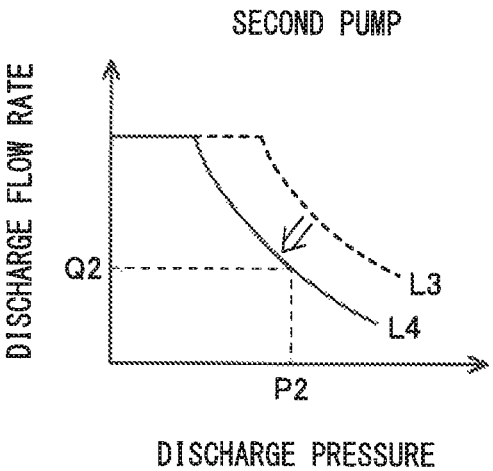

In the present embodiment, a plurality of first setting lines each indicating different horsepower are stored in a memory of the controller 8 as first horsepower control lines each restricting the discharge flow rate of the first pump 15, and a plurality of second setting lines each indicating different horsepower are also stored in the memory of the controller 8 as second horsepower control lines each restricting the discharge flow rate of the second pump 17. As shown in FIG. 12A, the controller 8 selects one of the first setting lines as a first main horsepower control line L1, which is to be used at a normal time, and selects another first setting line that indicates less horsepower than the first main horsepower control line L1 as a first auxiliary horsepower control line L2. Also, as shown in FIG. 12B, the controller 8 selects one of the second setting lines as a second main horsepower control line L3, which is to be used at a normal time, and selects another second setting line that indicates less horsepower than the second main horsepower control line L3 as a second auxiliary horsepower control line L4. It should be noted that the second main horsepower control line L3 may be the same as or different from the first main horsepower control line L1. Similarly, the second auxiliary horsepower control line L4 may be the same as or different from the first auxiliary horsepower control line L2.

Figure 11:
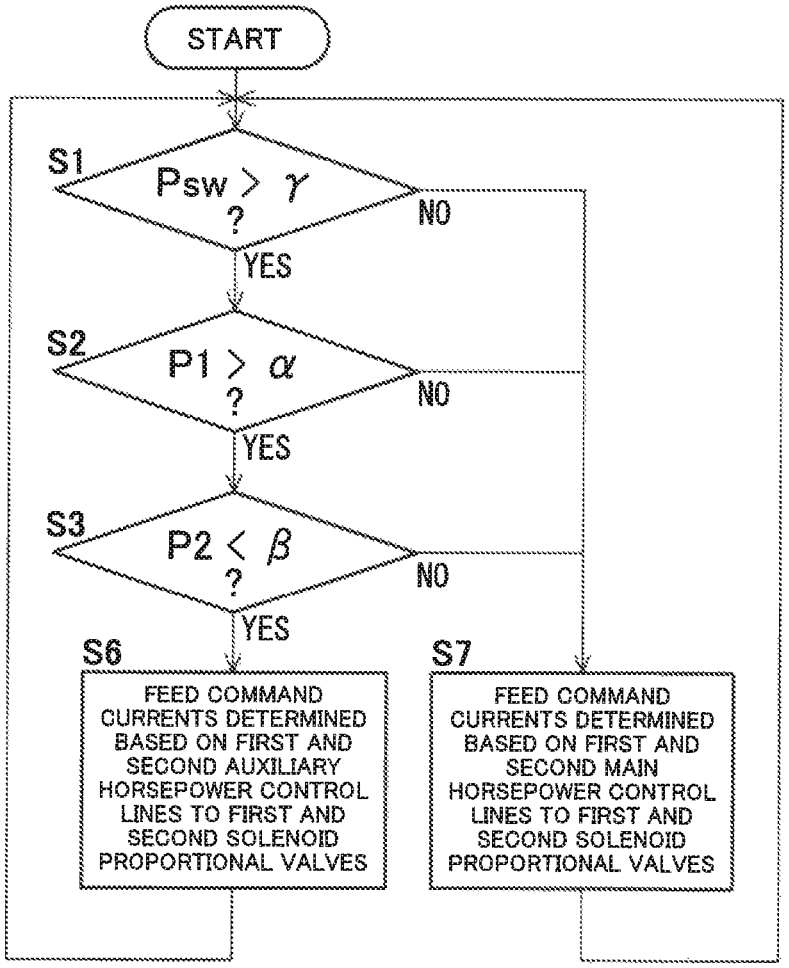
FIG. 11 is a flowchart of control performed by the controller in Embodiment 4.

In the present embodiment, as shown in FIG. 11, the controller 8 performs the processes of steps S1 to S3, which are the same as those described in Embodiment 1. However, if it is determined YES in step S3, the controller 8 proceeds to step S6, and if it is determined otherwise (i.e., NO in step S1, S2, or S3), the controller proceeds to step S7.

In step S7, to which the controller 8 proceeds when determining, for example, in step S1 that no turning operation is being performed, the controller 8 feeds a command current that is determined based on the first main horsepower control line L1 to the first solenoid proportional valve 61, and feeds a command current that is determined based on the second main horsepower control line L3 to the second solenoid proportional valve 62. On the other hand, while a turning operation is being performed (YES in step S1), if the discharge pressure P1 of the first pump 15 is higher than the first setting value $\alpha$ (YES in step S2) and the discharge pressure P2 of the second pump 17 is lower than the second setting value (YES in step S3), the controller 8 proceeds to step S6, in which the controller 8 feeds a command current that is determined based on the first auxiliary horsepower control line L2 to the first solenoid proportional valve 61, and feeds a command current that is determined based on the second auxiliary horsepower control line L4 to the second solenoid proportional valve 62. As a result, in step S6, the first horsepower control line is lowered as shown in FIG. 12A, and the second horsepower control line is lowered as shown in FIG. 12B.

The present embodiment provides the same advantages as those provided by Embodiment 1.

Figure 6:
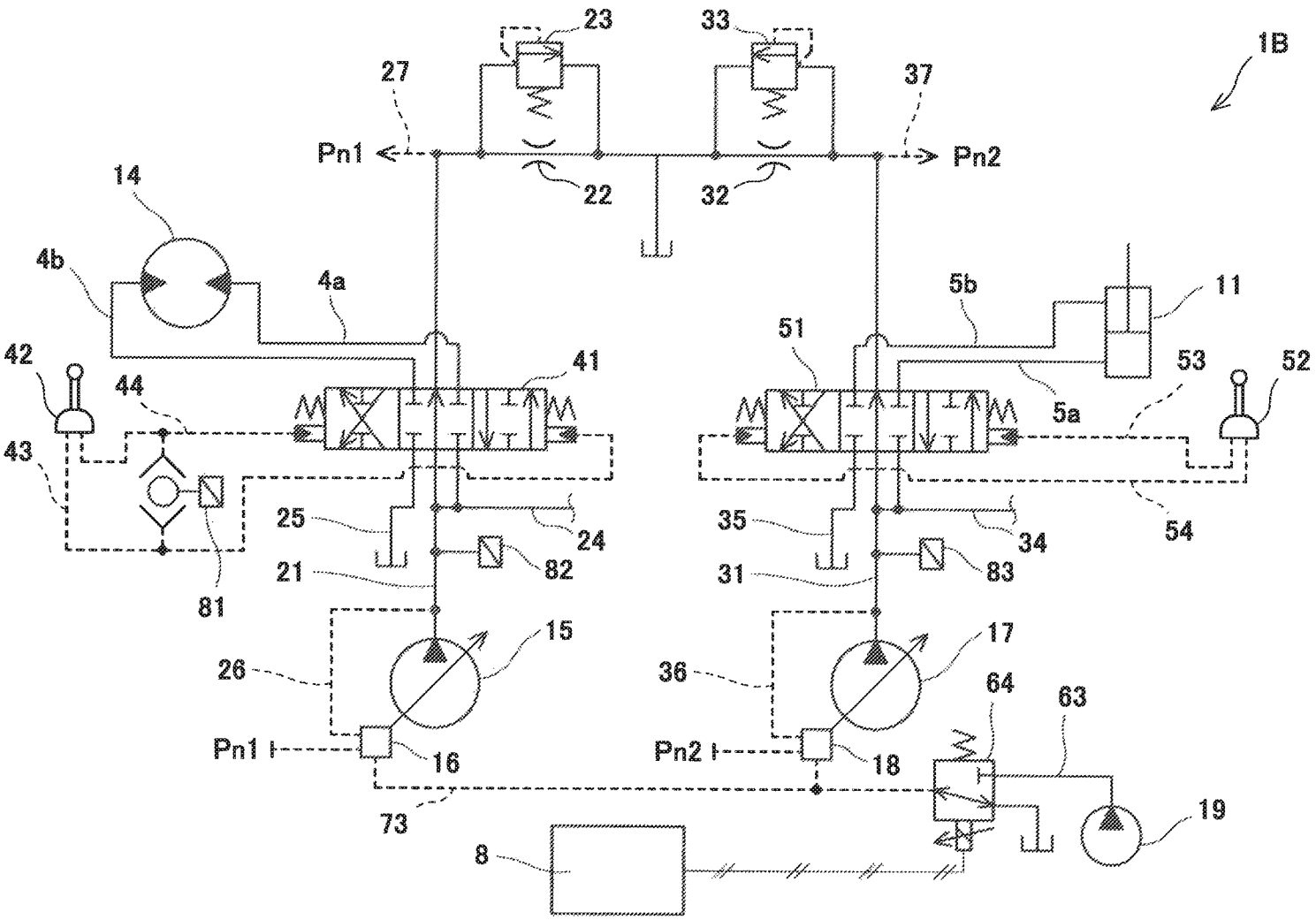
FIG. 6 shows a schematic configuration of a hydraulic drive system according to Embodiment 2 of the present invention.

It should be noted that, similar to Embodiment 2 shown in FIG. 6, the shared solenoid proportional valve 64, which outputs a secondary pressure to the first regulator 16 and the second regulator 18, may be used instead of the first solenoid proportional valve 61 and the second solenoid proportional valve 62.

OTHER EMBODIMENTS

The present invention is not limited to the above-described Embodiments 1 to 4. Various modifications can be made without departing from the spirit of the present invention.

For example, the determination as to whether or not a turning operation is being performed need not be based on the turning pilot pressure Psw measured by the turning pressure meter 81. As one example, an electrical signal indicating the inclination angle of the operating lever may be directly inputted into the controller 8 from the turning operation valve 42, and the controller 8 may determine whether or not a turning operation is being performed based on the electrical signal.

REFERENCE SIGNS LIST

1A to 1D hydraulic drive system
11 boom cylinder
14 turning motor
15 first pump
16 first regulator
17 second pump
18 second regulator
21 first circulation line
22 throttle
31 second circulation line
32 throttle
41 turning control valve
42 turning operation valve
51 boom control valve
52 boom operating valve
61 first solenoid proportional valve
62 second solenoid proportional valve
64 solenoid proportional valve
8 controller
81 turning pressure meter
82 first pump pressure meter
83 second pump pressure meter
97 flow rate control piston
98 horsepower control piston
99 multi-control piston

The invention claimed is:

1. A hydraulic drive system of a construction machine, the hydraulic drive system comprising:

a variable displacement first pump;

a turning control valve disposed on a first circulation line extending from the first pump to a tank, the turning control valve controlling supply and discharge of hydraulic oil to and from a turning motor;

a variable displacement second pump;

a boom control valve disposed on a second circulation line extending from the second pump to the tank, the boom control valve controlling supply and discharge of hydraulic oil to and from a boom cylinder;

a first regulator that changes a tilting angle of the first pump;

a second regulator that changes a tilting angle of the second pump;

one or more solenoid proportional valves that output a secondary pressure to the first regulator and the second regulator;

a first pump pressure meter that measures a discharge pressure of the first pump;

a second pump pressure meter that measures a discharge pressure of the second pump; and a controller that controls the one or more solenoid proportional valves, wherein while a turning operation is being performed, if the discharge pressure of the first pump, which is measured by the first pump pressure meter, is higher than a first setting value, and the discharge pressure of the second pump, which is measured by the second pump pressure meter, is lower than a second setting value, the controller feeds a command current to the one or more solenoid proportional valves, such that a first horsepower control line that restricts the discharge flow rate of the first pump and a second horsepower control line that restricts the discharge flow rate of the second pump are lowered.

2. The hydraulic drive system of a construction machine according to claim 1, wherein each of the first regulator and the second regulator includes a multi-control piston that receives the secondary pressure outputted from the one or more solenoid proportional valves, a first main horsepower control line and a first auxiliary horsepower control line indicating less horsepower than the first main horsepower control line are each stored as the first horsepower control line in the controller, a second main horsepower control line and a second auxiliary horsepower control line indicating less horsepower than the second main horsepower control line are each stored as the second horsepower control line in the controller, and while a turning operation is being performed, if the discharge pressure of the first pump is higher than the first setting value and the discharge pressure of the second pump is lower than the second setting value, the controller feeds a command current that is determined based on the first auxiliary horsepower control line and a command current that is determined based on the second auxiliary horsepower control line to the one or more solenoid proportional valves.

3. The hydraulic drive system of a construction machine according to claim 1, wherein the first regulator includes:

a flow rate control piston that receives a first negative control pressure, which is a pressure at an upstream side of a throttle provided on the first circulation line; and a horsepower control piston that receives the discharge pressure of the first pump and the secondary pressure outputted from the one or more solenoid proportional valves and that determines the first horsepower control line, the second regulator includes:

a flow rate control piston that receives a second negative control pressure, which is a pressure at an upstream side of a throttle provided on the second circulation line; and a horsepower control piston that receives the discharge pressure of the second pump and the secondary pressure outputted from the one or more solenoid proportional valves and that determines the second horsepower control line, and while a turning operation is being performed, if the discharge pressure of the first pump is higher than the first setting value and the discharge pressure of the second pump is lower than the second setting value, the controller feeds a command current to the one or more solenoid proportional valves, such that the secondary pressure outputted from the one or more solenoid proportional valves increases.

4. The hydraulic drive system of a construction machine according to claim 1, further comprising a turning pressure meter that measures a turning pilot pressure outputted from a turning operation valve to the turning control valve, wherein the controller determines that a turning operation is being performed if the turning pilot pressure measured by the turning pressure meter is higher than a threshold.

5. The hydraulic drive system of a construction machine according to claim 2, further comprising a turning pressure meter that measures a turning pilot pressure outputted from a turning operation valve to the turning control valve, wherein the controller determines that a turning operation is being performed if the turning pilot pressure measured by the turning pressure meter is higher than a threshold.

6. The hydraulic drive system of a construction machine according to claim 3, further comprising a turning pressure meter that measures a turning pilot pressure outputted from a turning operation valve to the turning control valve, wherein the controller determines that a turning operation is being performed if the turning pilot pressure measured by the turning pressure meter is higher than a threshold.

* * * * *